US010001746B2

(12) United States Patent
Tanaka et al.

(10) Patent No.: US 10,001,746 B2
(45) Date of Patent: Jun. 19, 2018

(54) IMAGE HEATING APPARATUS

(71) Applicant: CANON KABUSHIKI KAISHA, Tokyo (JP)

(72) Inventors: Noriaki Tanaka, Suntou-gun (JP); Yoshinori Hashimoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/139,654

(22) Filed: Apr. 27, 2016

(65) Prior Publication Data

US 2016/0327900 A1 Nov. 10, 2016

(30) Foreign Application Priority Data

May 7, 2015 (JP) ..... 2015-094742
Mar. 15, 2016 (JP) ..... 2016-050770

(51) Int. Cl.
*G03G 15/20* (2006.01)
*G03G 21/16* (2006.01)

(52) U.S. Cl.
CPC ..... *G03G 21/1685* (2013.01); *G03G 15/2017* (2013.01); *G03G 21/1647* (2013.01); *G03G 2215/2035* (2013.01)

(58) Field of Classification Search
CPC ..... H04N 1/00; H04N 1/00527; H04N 1/04; H04N 1/00795; H04N 1/00551; G03G 21/1685
See application file for complete search history.

(56) References Cited

U.S. PATENT DOCUMENTS

| | | | | |
|---|---|---|---|---|
| 8,170,458 | B2 | 5/2012 | Nakahara et al. | |
| 8,515,326 | B2 | 8/2013 | Nakahara et al. | |
| 2003/0077092 | A1 | 4/2003 | Ogawa et al. | |
| 2010/0028062 | A1 | 2/2010 | Nakahara et al. | |
| 2012/0183336 | A1 | 7/2012 | Nakahara et al. | |
| 2015/0037078 | A1* | 2/2015 | Ohta | G03G 15/2053 399/329 |
| 2015/0093159 | A1 | 4/2015 | Matsuno | |
| 2015/0139706 | A1 | 5/2015 | Fujiwara et al. | |
| 2015/0139708 | A1 | 5/2015 | Shimura et al. | |

FOREIGN PATENT DOCUMENTS

| | | | |
|---|---|---|---|
| JP | 2006350002 | A | 12/2006 |
| JP | 2010-038956 | A | 2/2010 |
| JP | 2012047868 | A | 3/2012 |
| JP | 5388498 | B2 | 1/2014 |
| JP | 2015068907 | A | 4/2015 |

* cited by examiner

*Primary Examiner* — David M Gray
*Assistant Examiner* — Michael Harrison
(74) *Attorney, Agent, or Firm* — Fitzpatrick, Cella, Harper & Scinto

(57) ABSTRACT

An image heating apparatus includes a frame including a first side plate and a second side plate, a cylindrical rotatable member, a heater, a holder having a length longer than a distance between the first and second side plates, a first preventing member, and a second preventing member. An image formed on a recording material is heated by heat of the heater while moving in a state in which the recording material contacts the rotatable member. The holder is unintegral with the first and second preventing members. The holder includes a positioning portion, contacting the first side plate, for positioning a position of the holder with respect to the longitudinal direction.

19 Claims, 12 Drawing Sheets

IMAGE HEATING APPARATUS

FIELD OF THE INVENTION AND RELATED ART

The present invention relates to an image heating apparatus suitable when being used as a fixing device (film apparatus) mounted in an image forming apparatus, such as a copying machine or a printer, of an electrophotographic type.

As the fixing device mounted in the electrophotographic copying machine or printer, a fixing device of a film type has been known. The fixing device of this type includes a heater in which a heat generating element which generates heat by energization is formed along a longitudinal direction of a ceramic-made substrate, and a pressing roller for forming a nip via a film in cooperation with the heater. A recording material carrying an unfixed toner image is heated while being nipped and fed at the nip of the fixing device, so that the toner image is fixed on the recording material.

The fixing device using the film has such an advantage that a time required from start of energization to the heater until a film temperature increases up to a fixable temperature is short. Accordingly, the printer in which the fixing device is mounted can shorten a time (FPOT: first print out time) from after a print instruction (command) is inputted until an image on a first sheet is outputted. The fixing device of this type has also such an advantage that electric power consumption during stand-by waiting for the print instruction is reduced. The fixing device has the advantages as described above, and therefore has been introduced into a high-speed image forming apparatus in recent years. For that reason, for the purpose of further improving heat conduction efficiency, a technique to optimize a heater position has been devised.

Japanese Patent No. 5388498 discloses a fixing device in which the heater position is optimized by positioning a heater holder for holding the heater relative to a frame with respect to a feeding direction. The fixing device disclosed in Japanese Patent No. 5388498 is effective for improving the heat conduction efficiency by optimizing positioning of the heater holder with respect to a recording material feeding direction.

In the fixing device using the film, in order to improve the heat conduction efficiency, optimization of positioning of the heater relative to the frame with respect to a longitudinal direction perpendicular to the recording material feeding direction is required.

With reference to FIGS. 17 and 18, a positioning structure of a heater holder with respect to a longitudinal direction in a conventional fixing device will be described. FIG. 17 is a front view of the conventional fixing device as seen from a downstream side with respect to a recording material feeding direction (direction perpendicular to the drawing sheet surface). FIG. 18 is a front view of a heating unit, from which a film 13 is demounted, as seen from the downstream side with respect to the recording material feeding direction. The positioning structure of the fixing device in an upstream side with respect to the recording material feeding direction is not illustrated, but is the same as that in the downstream side with respect to the recording material feeding direction.

As shown in FIG. 17, left and right frames 19*a*, 19*b* of the fixing device are provided with grooves (not shown). In these grooves, bearings 20*a*, 20*b* are mounted and positioned and hold (support) a metal core 17*a* of a pressing roller 17. Flanges 16*a*, 16*b* of a heating unit 18 are mounted in grooves provided in the frames 19*a*, 19*b* so as to be vertically slidable. By both of the flanges 16*a*, 16*b*, a position of the film 13 with respect to a longitudinal direction (X-axis direction) of the fixing device perpendicular to the recording material feeding direction (Y-axis direction) is regulated. A position of a heater holder 15 with respect to the recording material feeding direction (Y-axis direction) is determined by abutment of positioning portions 25*a*, 25*b* against rim portions (not shown) of the frames 19*a*, 19*b* constituting the grooves of the frames 19*a*, 19*b*. A gear 21 mounted to a metal core 17*a* of the pressing roller 17 is rotated by power of an unshown motor, so that the pressing roller 17 is rotated. The film 13 contacting the pressing roller 17 is rotated by rotation of the pressing roller 17.

As shown in FIG. 18, the flanges 16*a*, 16*b* receive an urging (pressing) force of urging (pressing) springs 30*a*, 30*b* via pressing plates 32*a*, 32*b*. The urging force received by the flanges 16*a*, 16*b* is received by the heater holder 15 and is transmitted to a heater 14.

Then, a position of a stay 27 of the fixing device with respect to a longitudinal direction X will be described. The stay 27 is provided between the flanges 16*a*, 16*b*. There is a gap between the stay 27 and the flanges 16*a*, 16*b* with respect to the longitudinal direction X, but the position of the stay 27 is roughly determined by abutment of abutment portions 37*a*, 37*b* provided on the stay 27 against the flanges 16*a*, 16*b*, respectively. As described above, between the flanges 16*a*, 16*b* and the abutment portions 37*a*, 37*b*, a gap determined in consideration of a dimensional tolerance and thermal expansion of components (parts) is provided. Between the abutment portions 37*a*, 37*b*, a dimension is relatively large (200 mm or more in the printer using A4-sized paper and Letter-sized paper), and therefore, the above gap is relatively large.

Next, a position of the heater holder 15 of the fixing device with respect to the longitudinal direction X will be described. As shown in FIG. 18, the heater holder 15 is provided with abutment portions 34*a*, 34*b*. The position of the heater holder 15 is roughly determined by abutment of the abutment portions 34*a*, 34*b* of the heater holder 15 against the stay 27. Between the stay 27 and the abutment portions 34*a*, 34*b*, a gap determined in consideration of a dimensional tolerance and thermal expansion of components (parts) is provided. Between the abutment portions 34*a*, 34*b*, a dimension is relatively large (200 mm or more in the printer using A4-sized paper and Letter-sized paper), and therefore, the above gap is relatively large.

Next, a position of the heater 14 will be described. With respect to the longitudinal direction X, one end of the heater 14 abuts against an abutment portion 29 provided on the heater holder 15, whereby the position of the heater 14 with respect to the longitudinal direction X is roughly determined.

As described above, with respect to the longitudinal direction X of the fixing device, the position of the heater 14 relative to the frames 19*a*, 19*b* is roughly determined by the flanges 16*a*, 16*b*, the stay 27 and the heater holder 15. However, as described above, the gaps determined in consideration of the dimensional tolerances and thermal expansion of the respective components exist, and therefore play corresponding to the gaps causes a variation in position of the heater 14 with respect to the longitudinal direction X. The position of the heater 14 with respect to the longitudinal direction X varies in every individual printer. Even when there is an individual variation as described above, in order to prevent improper film use irrespective of the individual printer, there is a need to take such a countermeasure that a target control temperature of the heater is set at a high level for all of the printers. However, in such a countermeasure, energy consumption of the fixing device increases, so that there is room for improvement.

SUMMARY OF THE INVENTION

A principal object of the present invention is to provide an image heating apparatus excellent in positional accuracy of a heater relative to a frame.

According to an aspect of the present invention, there is provided an image heating apparatus comprising: a frame including a first side plate provided at one end portion and a second side plate provided at the other end portion with respect to a longitudinal direction of the image heating apparatus; a cylindrical rotatable member provided between the first and second side plates; a heater contacting an inner surface of the rotatable member; a holder for holding the heater, wherein the holder is provided in an inside space of the rotatable member and with respect to the longitudinal direction, a length of the holder is longer than a distance between the first and second side plates; a first preventing member, contactable to one end surface of the rotatable member when the rotatable member moves toward the first side plate, for preventing movement of the rotatable member in the longitudinal direction; and a second preventing member, contactable to the other end surface of the rotatable member when the rotatable member moves toward the second side plate, for preventing the movement of the rotatable member in the longitudinal direction, wherein an image formed on a recording material is heated by heat of the heater while moving in a state in which the recording material contacts the rotatable member, wherein the holder is unintegral with the first and second preventing members, and wherein the holder includes a positioning portion, contacting the first side plate, for positioning a position of the holder with respect to the longitudinal direction.

Further features of the present invention will become apparent from the following description of exemplary embodiments with reference to the attached drawings.

DESCRIPTION OF THE EMBODIMENTS

In the following, embodiments of the present invention will be described with reference to the drawings. The following embodiments are an example of preferred embodiments of the present invention, but the present invention is not limited to the following embodiments. It is possible to replace various constitutions with other constitutions within the scope of the concept of the present invention.

Embodiment 1

(1) Image Forming Apparatus

Figure 16:
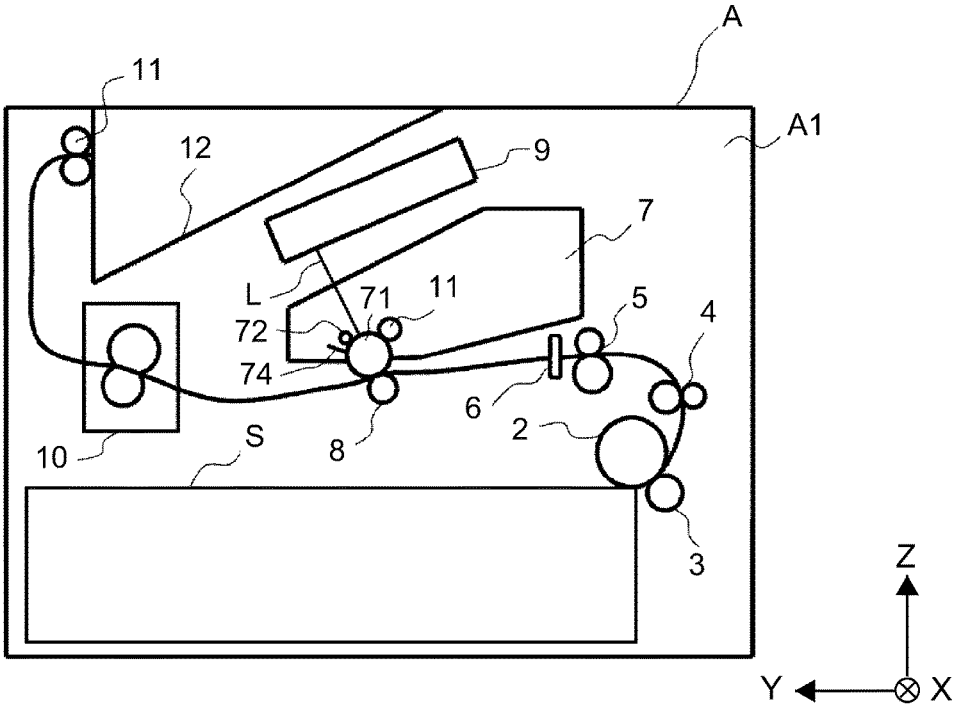
FIG. 16 is a sectional view of an image forming apparatus.
Figure 17:
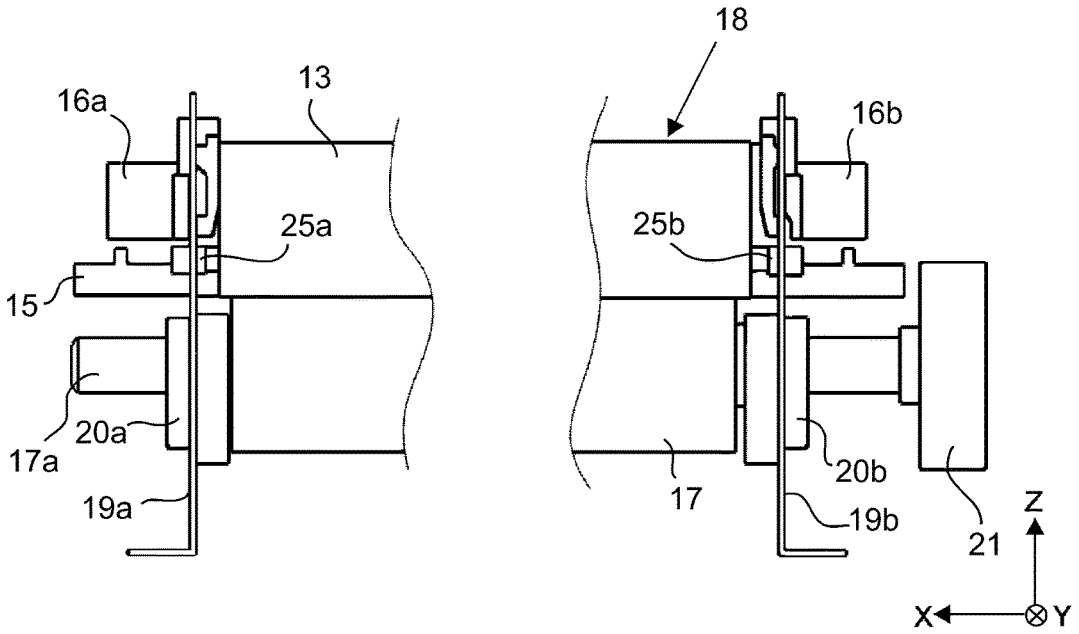
FIG. 17 is a front view of a conventional fixing device.
Figure 18:
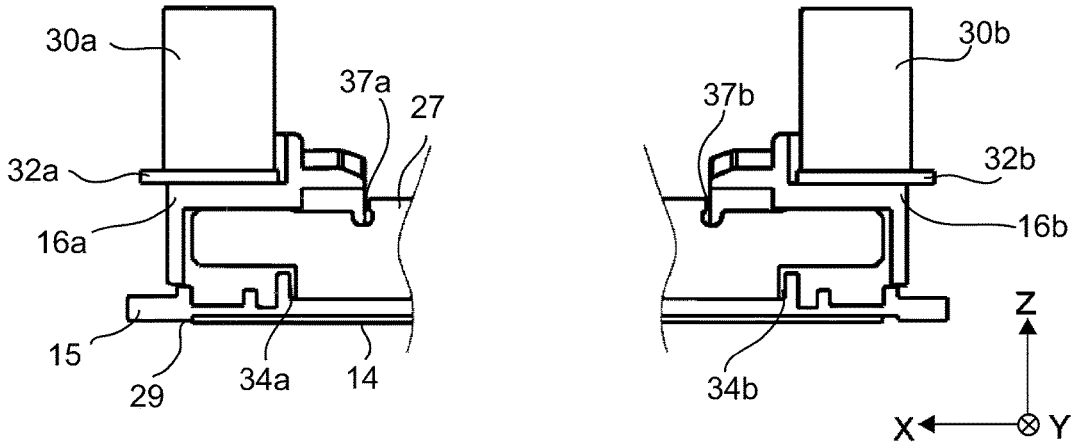
FIG. 18 is a front view of a conventional heating unit.

With reference to FIG. 16, an image forming apparatus in which an image heating apparatus according to the present invention is mounted as a fixing device will be described. FIG. 16 is a sectional view showing a schematic structure of an example of an image forming apparatus (monochromatic laser printer in this embodiment) A using an electrophotographic recording technology.

The image forming apparatus A in this embodiment forms an image on a recording material S as a material-to-be-heated in a state in which a process cartridge 7 is detachably mounted in an apparatus main assembly A1 of the image forming apparatus A. Here, the process cartridge 7 integrally includes a photosensitive drum 71, a charging member 72, a developing device 73 and a cleaner 74. A process of image formation by this process cartridge is well known and therefore detailed description will be omitted.

In the following, the image formation on the recording material S will be described. The recording material S stacked in a cassette 1 is separated and fed by rollers 2, 3 and then is conveyed to a roller pair 4. Then, the roller pair 4 feeds the recording material S to a roller pair 5. Then, the recording material S passes through a sensor 6 and is fed to a nip between the photosensitive drum 71 and a transfer roller 8.

On the other hand, a laser scanner 9 irradiates the photosensitive drum 71 with laser light L in synchronism with timing of leading end detection of the recording material S by the sensor 6, so that a toner image is formed on the surface of the photosensitive drum 71 by a process in the process cartridge 7. The toner image is transferred onto the recording material S nipped between the photosensitive drum 71 and the transfer roller 8. The recording material S on which the toner image is transferred is fed to a film device 10, and the toner image is fixed on the recording material S by the film device 10. The recording material S on which the toner image is fixed is discharged onto a tray 12 by a roller pair 11.

(2) Fixing Device 10

Figure 1:
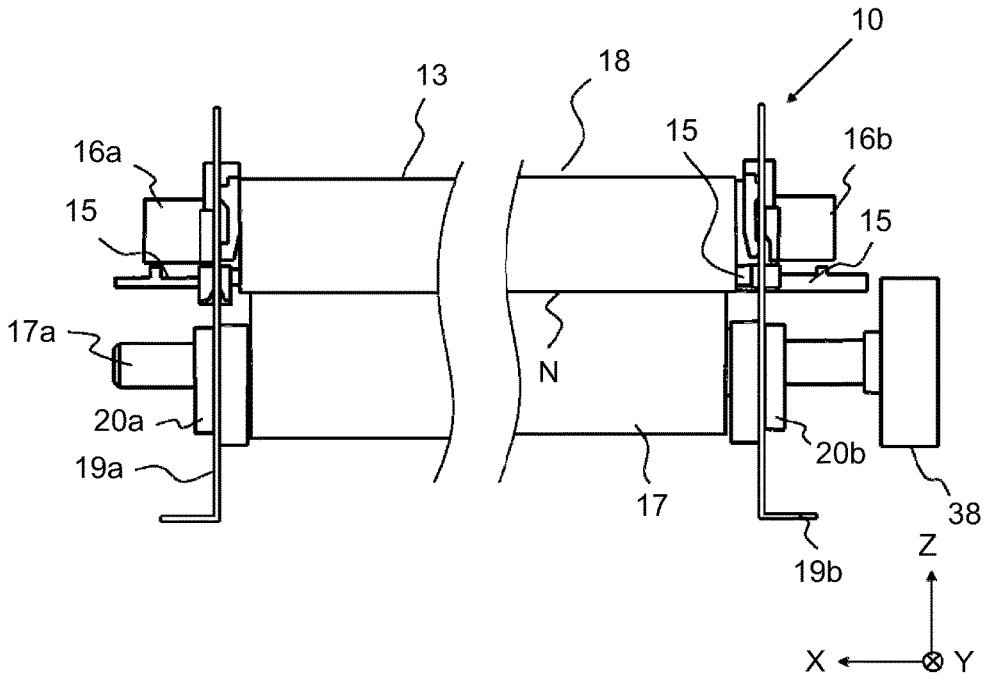
FIG. 1 is a front view of a fixing device in Embodiment 1.
Figure 2:
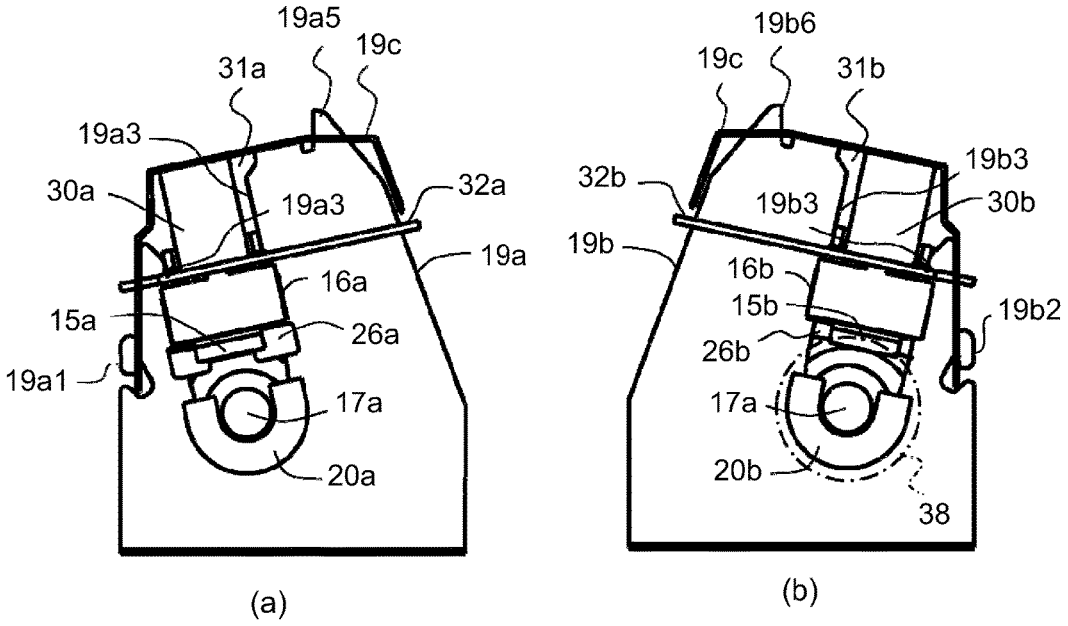
In FIG. 2, (*a*) and (*b*) are a left side view and a right side view, respectively, of the fixing device in Embodiment 1.
Figure 3:
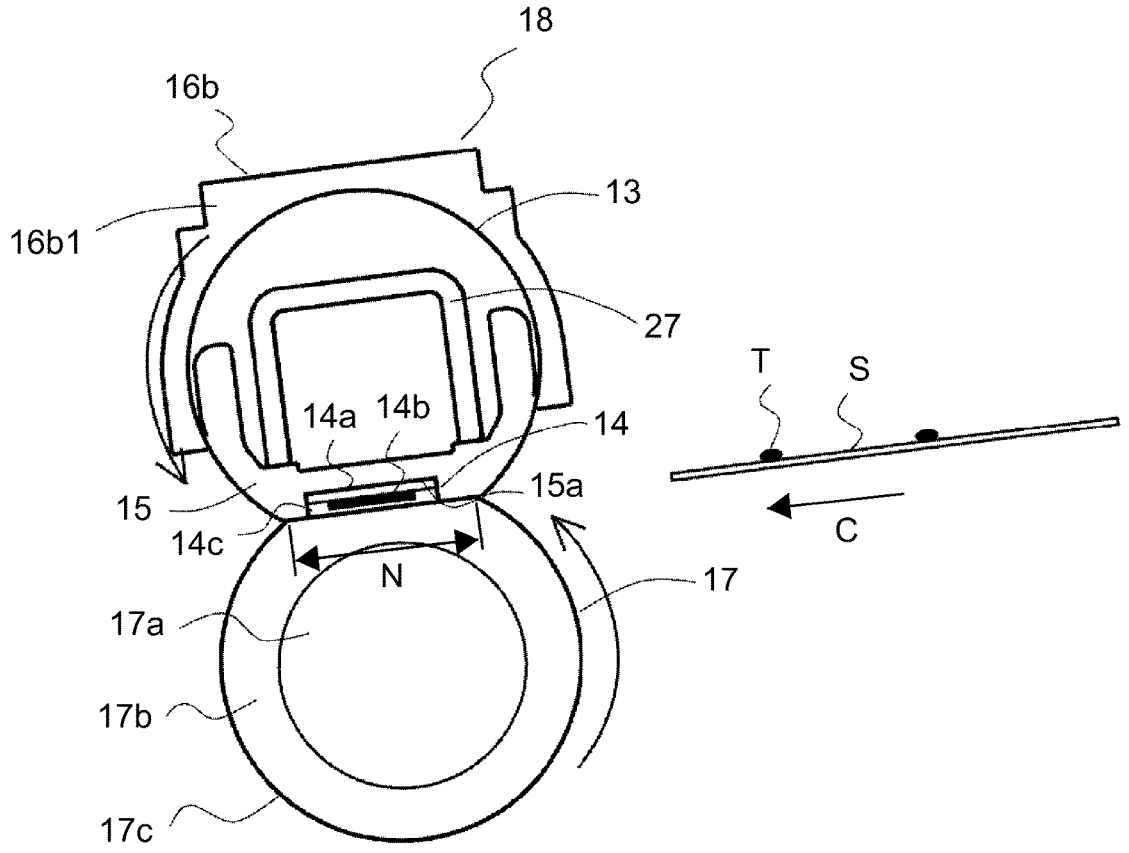
FIG. 3 is a sectional view of the fixing device in Embodiment 1.
Figure 4:
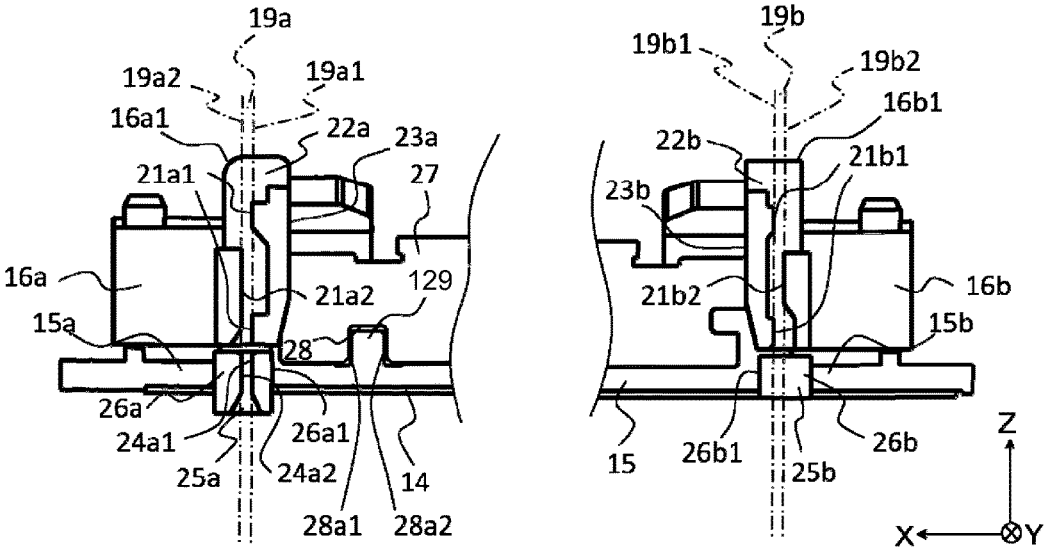
FIG. 4 is a front view of a heating unit in Embodiment 1.
Figure 5:
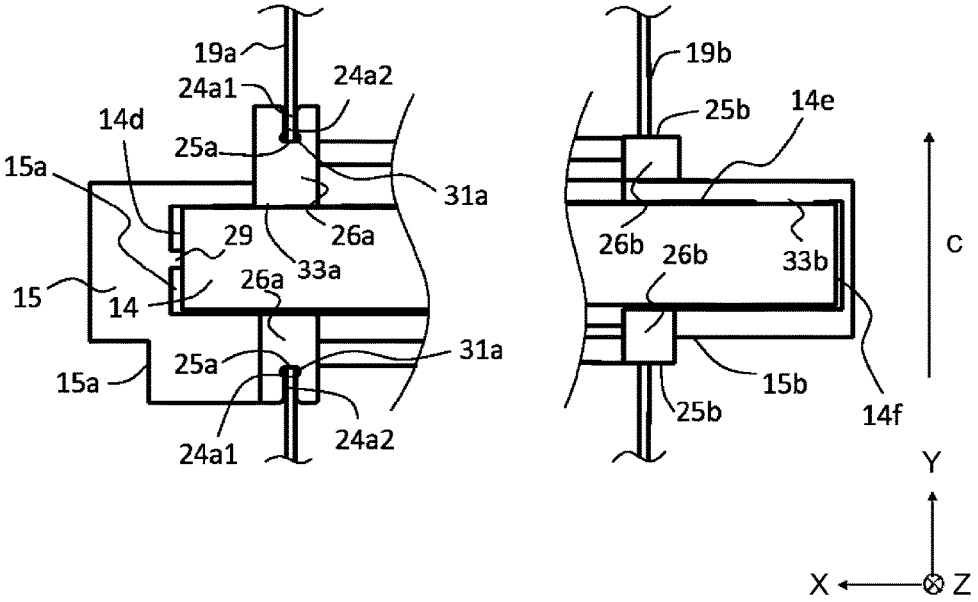
FIG. 5 is a bottom view of the heating unit in Embodiment 1.
Figure 6:
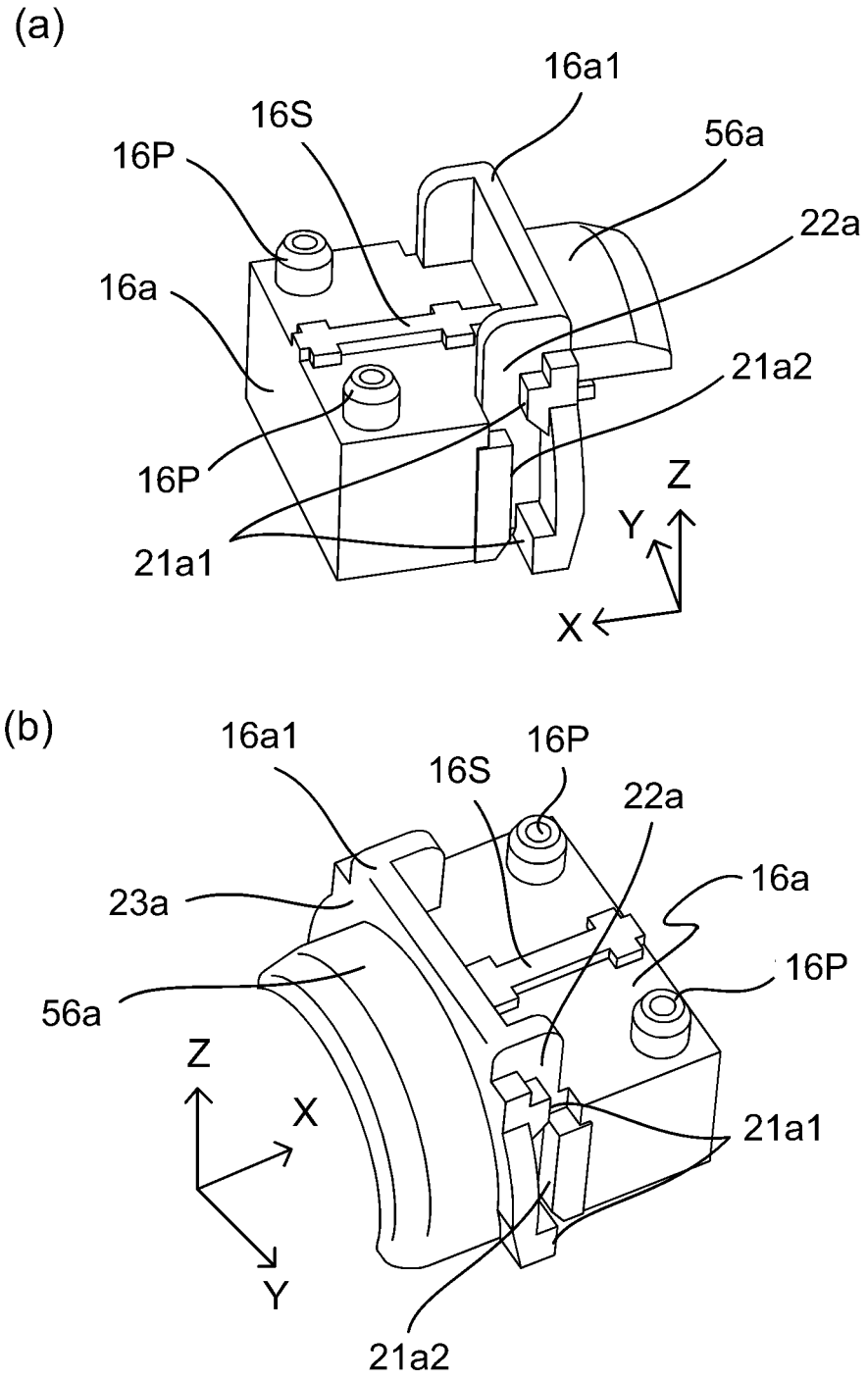
In FIG. 6, (*a*) and (*b*) are perspective views of a flange.
Figure 7:
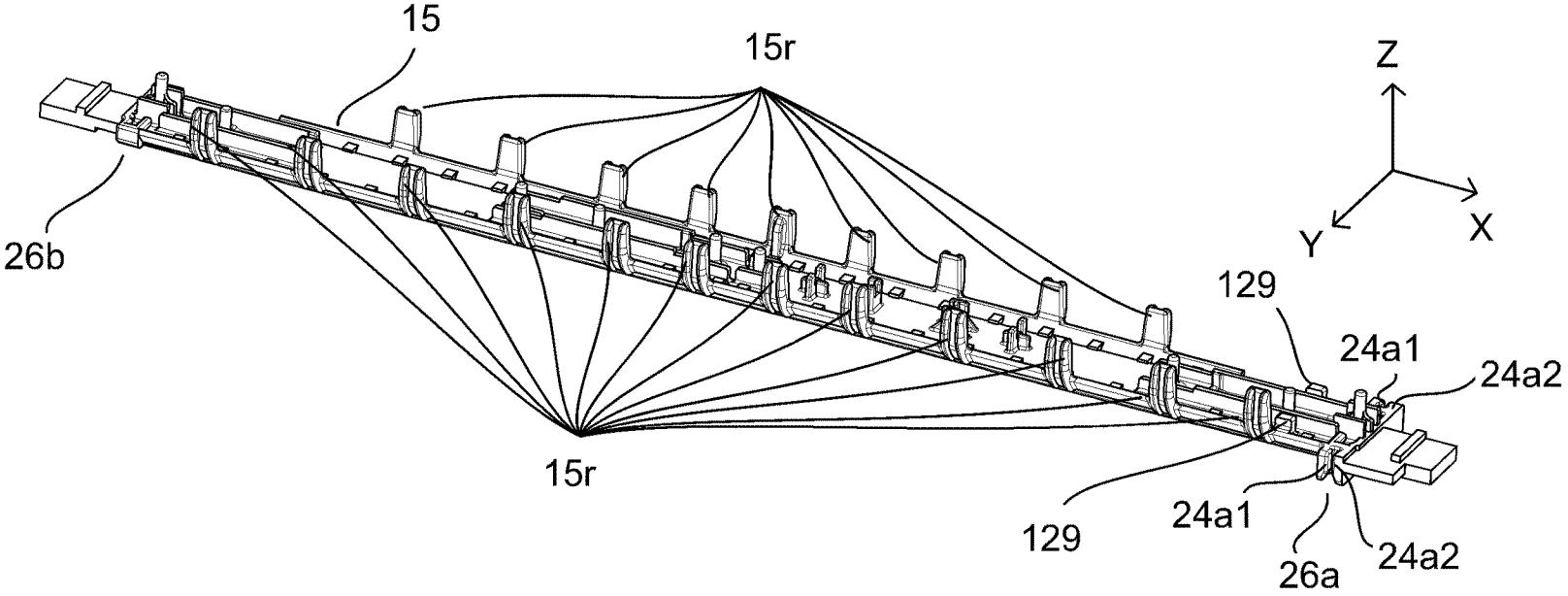
FIG. 7 is a perspective view of a heater holder.
Figure 8:
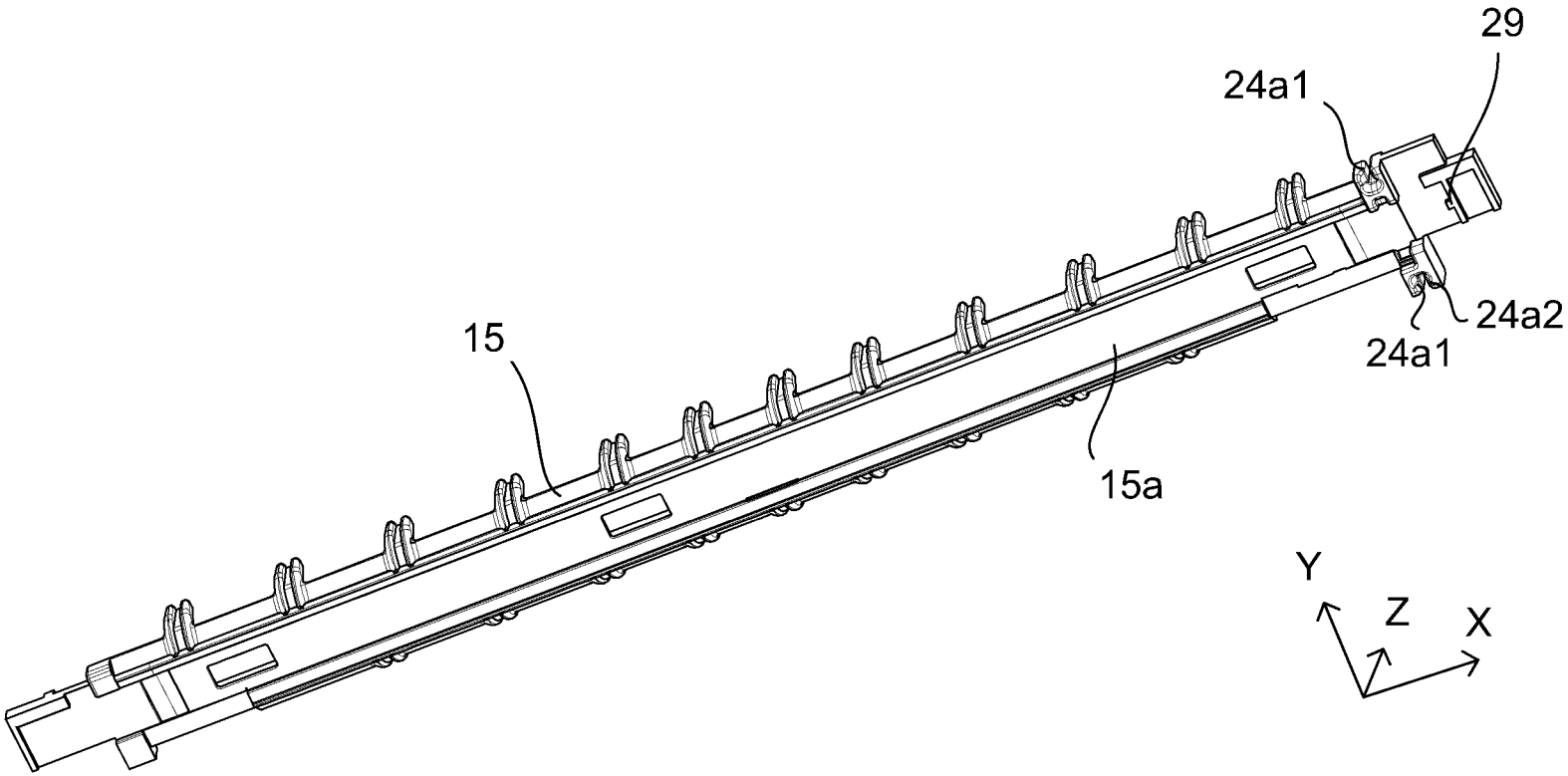
FIG. 8 is a perspective view of the heater holder.
Figure 9:
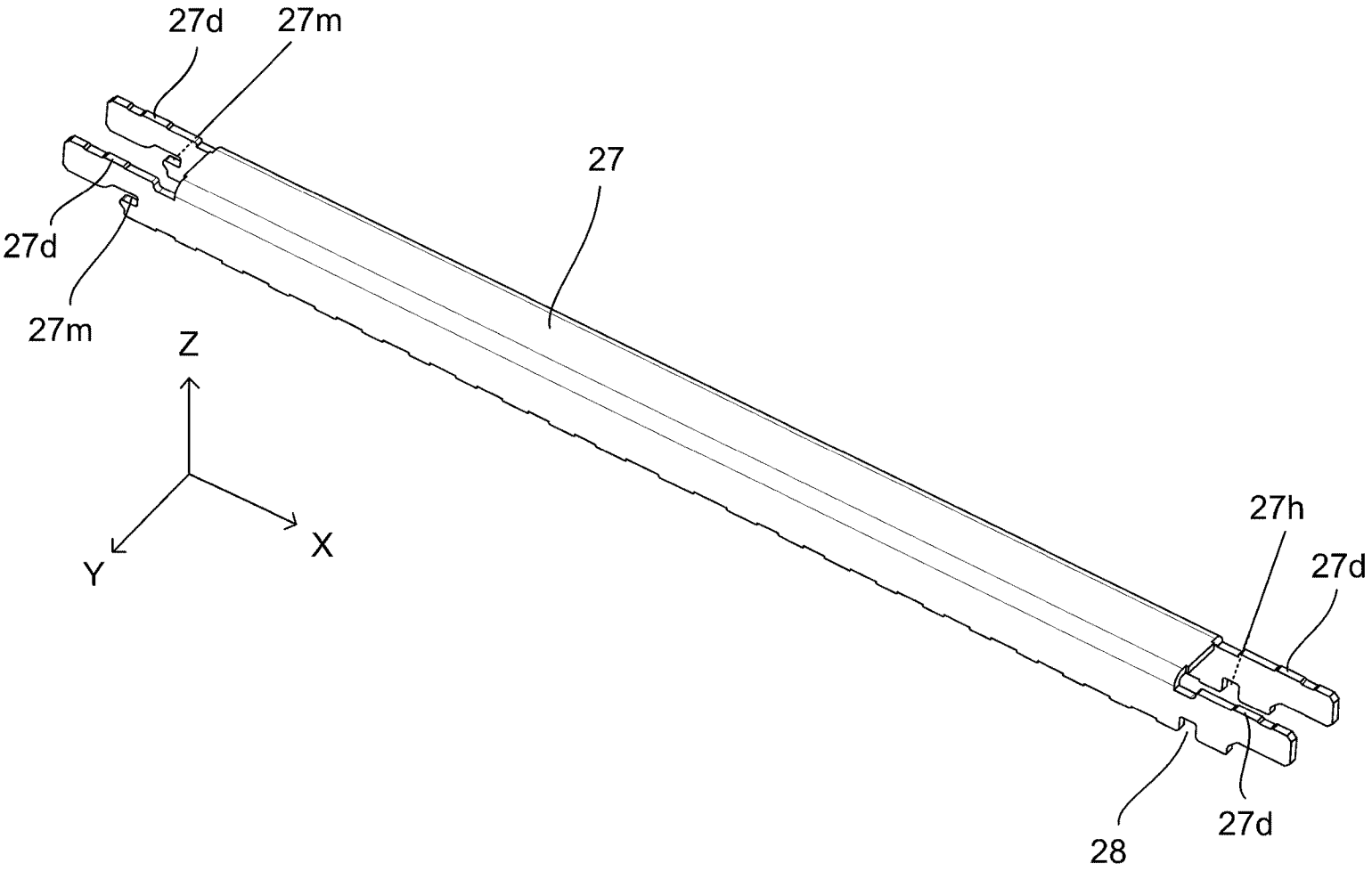
FIG. 9 is a perspective view of a stay.
Figure 10:
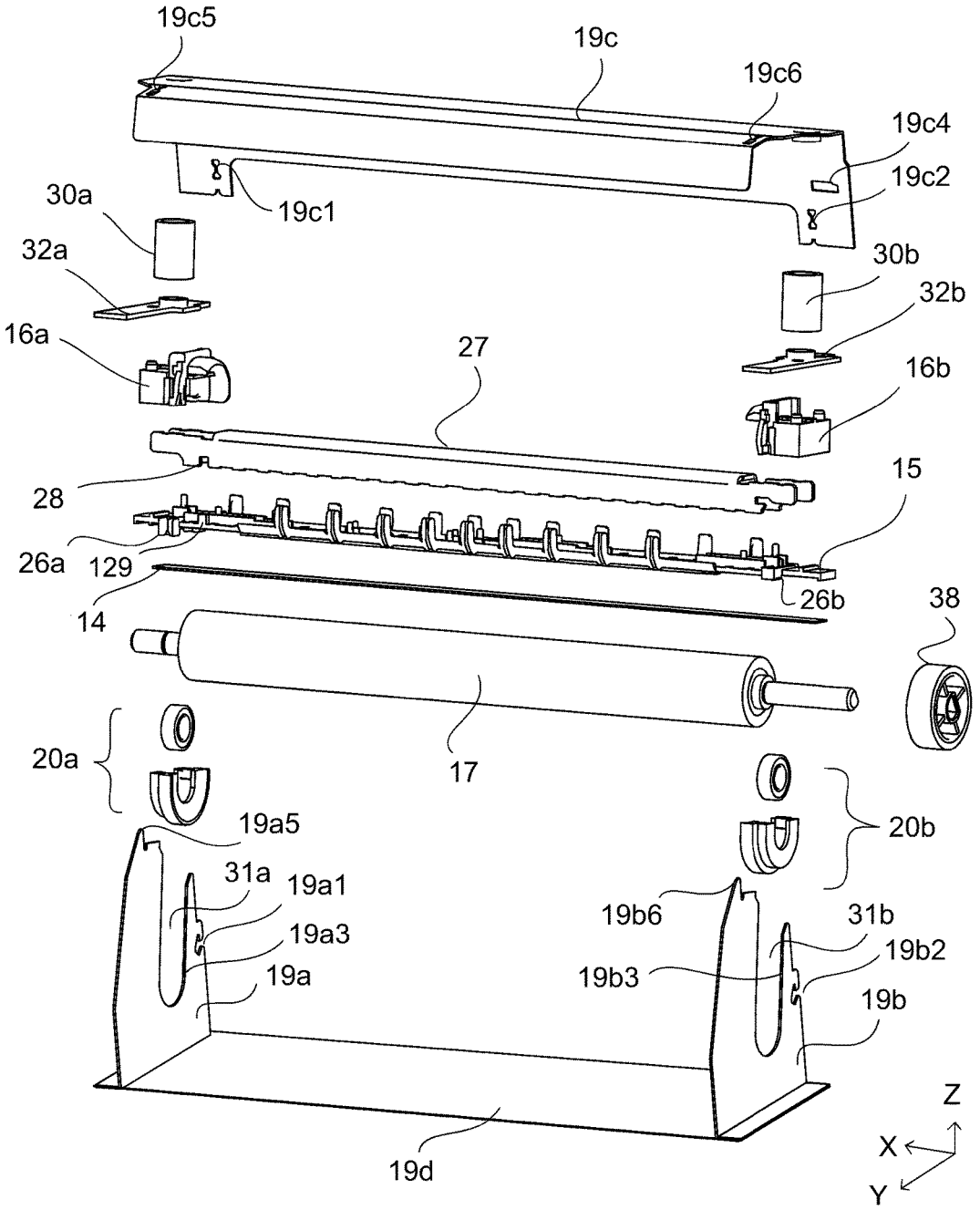
FIG. 10 is an exploded view of the fixing device.

The fixing device 10 in this embodiment will be described with reference to FIGS. 1 to 10. In FIGS. 1 to 5, members which are the same as those in a conventional fixing device will be represented by the same reference numerals or symbols. FIG. 1 is a front view of the fixing device 10 as seen from a downstream side of a feeding direction C of the recording material S (material-to-be-heated). In FIG. 2, (*a*) is a left side view of the fixing device 10, and (*b*) is a right side view of the fixing device 10. FIG. 3 is a sectional view of the fixing device 10. FIG. 4 is an enlarged view of left and right end portions of the fixing device 10 of FIG. 1. FIG. 5 is a schematic view of a heating unit 18, in a state in which a pressing roller 17 described later is demounted, as seen in Y direction. In FIG. 6, (*a*) and (*b*) are perspective views of a flange 16*a* described later. FIGS. 7 and 8 are perspective views of a heater holder 15 described later. FIG. 9 is a perspective view of a stay 27 described later. FIG. 10 is an exploded view of the fixing device 10. Incidentally, in FIG. 10, a film 13 described later is omitted.

As shown in FIGS. 1 to 3, the fixing device 10 includes the heating unit 18 and the pressing roller 17. The heating unit 18 includes a cylindrical film 13 as a flexible sleeve (cylindrical rotatable member), a heater 14 and the heater holder 15 as a supporting member for supporting the heater 14. The heating unit 18 further includes the stay 27 for reinforcing the heater holder 15, flanges 16*a* (first regulating member), 16*b* (second regulating member) for regulating a position of the film 13 with respect to a longitudinal direction perpendicular to the feeding direction C of the recording material S. The pressing roller 17 includes a metal core 17*a*, an elastic (member) layer 17*b* provided around the metal core 17*a*, and a parting layer (outermost layer) 17*c* provided around the elastic layer 17*b*. A material for the heater holder 15 is a heat-resistant resin material, and a LCP (liquid crystal polymer) is used in this embodiment. The heater holder 15 is also a guiding member for guiding rotation of the film 13. A material for the stay 27 is metal, and a zinc-plated steel plate (iron) is used in this embodiment.

The heater holder 15 is disposed in a cylinder of the film 13 so that end portions thereof protrude from an inside of the cylinder of the film 13. At positions opposing the end portions of the heater holder 15, flanges 16*a*, 16*b* are disposed, respectively.

The heater 14 includes an elongated substrate 14*a* extending in an X-axis direction, a heat generating resistor 14*b* provided along a longitudinal direction of the substrate 14*a*, and a protective layer 14*c* covering the heat generating resistor 14*b*. This heater 14 is supported by a recessed portion 15*a* provided at a flat portion of the heater holder 15 so that the protective layer 14*c* slides with an inner surface of the film 13. Left and right frames 19*a* (first side plate), 19*b* (second side plate) as device frames for positioning the pressing roller 17 with respect to a longitudinal direction (X-axis direction) of the fixing device perpendicular to the feeding direction of the recording material S include grooves 31*a*, 31*b* ((a) and (b) of FIG. 21), respectively. In the grooves 31*a*, 31*b*, bearings 20*a*, 20*b* are mounted and positioned, so that both end portions of the metal core 17*a* of the pressing roller 17 are held by the bearings 20*a*, 20*b*. Above the position of the metal core 17*a*, the heater holder 15 is positioned. With respect to the longitudinal direction (X-axis direction) of the fixing device, a length of the heater holder (guiding member) 15 is longer than a distance between the frame 19*a* and the frame 19*b*.

As shown in FIGS. 2 and 10, the frames 19*a*, 19*b* are fixed on a lower frame 19*d*. On the frames 19*a*, 19*b*, an upper frame 19*c* is mounted over the frames 19*a*, 19*b*. A hole 19*c*1 provided in the upper frame 19*c* engages with a hook portion 19*a*1 provided in the frame 19*a*. A hole 19*c*2 provided in the upper frame 19*c* engages with a hook portion 19*b*2 provided in the frame 19*b*. A hole 19*c*5 provided in the upper frame 19*c* engages with a projected portion 19*a*5 provided on the frame 19*a*. A hole 19*c*6 provided in the upper frame 19*c* engages with a projected portion 19*b*6 provided on the frame 19*b*.

When the fixing device is assembled, into a groove 31*a* of the frame 19*a* and a groove 31*b* of the frame 19*b*, the respective members are inserted (disposed) in the listed order shown below. The first (lowermost) is the bearings 20*a*, 20*b* for holding the shaft of the pressing roller 17, the second is the heater holder 15 in a state of holding the heater 14, the third is the stay 27 and the fourth is the flanges 16*a*, 16*b*. Of these members, the members contacting an edge portion 19*a*3 of the frame 19*a* forming the groove 31*a* and an edge portion 19*b*3 of the frame 19*b* forming the groove 31*b* are the bearings 20*a*, 20*b*, the heater holder 15 and the flanges 16*a*, 16*b*.

In the groove 31*a* of the frame 19*a* and the groove 31*b* of the frame 19*b*, the flanges 16*a*, 16*b* are positioned above the position of the heater holder 15 so as to be slidable vertically, so that a longitudinal position of the film 13 is regulated between the both flanges 16*a*, 16*b*. That is, the flange 16*a* is a member with which one end surface of the film 13 is in contact when the film 13 moves toward the frame 19*a*, and prevents movement of the film 13 in the longitudinal direction. Further, the flange 16*b* is a member with which the other end surface of the film 13 is in contact when the film 13 moves toward the frame 19*b*, and prevents movement of the film 13 in the longitudinal direction.

The flanges 16*a*, 16*b* ((a) and (b) of FIG. 2) disposed at positions opposing the end portion surfaces of the film 13 are urged (pressed) toward a direction perpendicular to a generatrix direction of the pressing roller 17 by urging (pressing) springs 30*a*, 30*b* as urging (pressing) members via urging (pressing) plates 32*a*, 32*b*. Both of the pressing springs 30*a*, 30*b* are compression springs, and each of these compression springs is sandwiched between the upper frame 19*c* and the associated pressing plate. As shown in FIG. 10, one end of the pressing plate 32*a* is inserted into a hole (not shown) provided in the upper frame 19*c*. One end of the pressing plate 32 is inserted into a hole 19*c*4 provided in the upper frame 19*c*.

Next, a structure of the flanges 16*a*, 16*b* will be described. In FIG. 6, (*a*) and (*b*) are perspective views of the flange 16*a*. Incidentally, also a structure of the flange 16*b* is substantially the same as the structure of the flange 16*a*, and therefore will be omitted from description.

The flange 16*a* includes a guiding portion 56*a*, a bearing surface portion 16S contactable to the pressing plate 32*a*, a positioning portion for positioning the pressing plate 32*a*, and a regulating portion 16*a*1 having a surface 23*a* contactable to an end surface of the film 13. Positioning portions 21*a*1, 21*a*2 position the flange 16*a* relative to the frame 19*a* with respect to the X direction.

Next, a structure of the heater holder 15 will be described. The heater holder 15 has the function of guiding the rotation of the film 13. FIGS. 7 and 8 are perspective views of the heater holder 15. The heater holder 15 includes ribs 15*r* for guiding the rotation of the film 13 and a recessed portion 15*a* in which the heater 14 is engaged. Positioning portions 24*a*1, 24*a*1 position the heater holder 15 relative to the frame 19*a* with respect to the X direction. A positioning portion 129 positions the stay 27 with respect to the X direction.

Next a structure of the stay 27 will be described. FIG. 9 is a perspective view of the stay 27. The stay 27 includes force receiving portions 27*d* for receiving forces of the pressing springs 30*a*, 30*b* in contact with the flanges 16*a*, 16*b*, and includes engaging portions 27*m* for engaging with the heater holder 15 when the stay 27 is mounted on the heater holder 15 while sliding the stay 27 in a −(minus) X direction. A positioning portion 28 positions the stay 27 relative to the heater holder 15 with respect to the X direction. The positioning portion 28 contacts a positioning portion 129 of the heater holder 15. The stay 27 presses the heater holder 15 by receiving pressing (urging) forces from the flanges 16*a*, 16*b*. The heater 14 is press-contacted to the inner surface of the film 13 by the heater holder 15, so that the heater 14 forms a nip N in cooperation with the pressing roller 17 via the film 13.

In the fixing device 10 in this embodiment, the pressing roller 17 is rotationally driven in an arrow direction (FIG. 3) via a gear 38 (FIG. 1) by drive of a motor (not shown). The film 13 is driven by the rotation of the pressing roller 17 to rotate in an arrow direction while sliding the inner surface of the film 13 with the protective layer 14*c* of the heater 14.

The gear 38 as a gear for driving the pressing roller 17 is a helical gear, and thrust generates in a direction (X direction) in which the pressing roller 17 moves toward the frame 19*a* during the drive of the pressing roller 17, so that the pressing roller 17 is shifted toward the frame 19*a* side. That is, the thrust, in the axial direction, generated during the drive of the pressing roller 17 is caused to generate in a positioning direction of the heater holder 15. The heater 14 generates heat by energization to the heat generating resistor 14*b*.

The recording material S carrying the unfixed toner image T is heated while being nipped and fed at the nip N, so that the toner image T is fixed on the recording material S.

FIG. 4 is a front view of the heating unit 18, from which the film 13 is demounted, as seen from the downstream side with respect to the feeding direction C of the recording material S. With reference to FIG. 4, (*a*) and (*b*) of FIG. 6 and FIG. 10, positioning between the left side flange 16*a* and the frame 19*a* and positioning between the right side flange 16*b* and the frame 19*b* will be described.

First, the positioning of the flange 16*a* relative to the frame 19*a* (indicated by a chain line) will be described. The flange 16*a* includes a position regulating portion 16*a*1 for regulating a position of a left side end portion of the film 13. The position regulating portion 16*a*1 is formed from an upstream side toward a downstream side of the flange 16*a* with respect to the feeding direction C of the recording material S. The position regulating portion 16*a*1 is provided with first positioning portions 21*a*1, a second positioning portion 21*a*2 and a third positioning portion 22*a*. By these positioning portions, the flange 16*a* is positioned relative to the frame 19*a*.

With respect to the longitudinal direction (X-axis direction) of the pressing roller 17, the positioning portions 21*a*1 oppose an inside surface 19*a*1 of the frame 19*a*, and the positioning portion 21*a*2 opposes an outside surface 19*a*2 of the frame 19*a*. With respect to the feeding direction C (Y-axis direction) of the pressing roller 17, the positioning portion 22*a* opposes an edge portion 19*a*3 ((*a*) of FIG. 2 and FIG. 10) of the frame 19*a* forming the groove 31*a*.

Therefore, the flange 16*a* is positioned relative to the frame 19*a* by the positioning portions 21*a*1, 21*a*2 with respect to the X-axis direction and by the positioning portion 22*a* with respect to the Y-axis direction.

Next, the positioning of the flange 16*b* relative to the frame 19*b* (indicated by a chain line) will be described. The flange 16*b* includes a position regulating portion 16*b*1 for regulating a position of a right side end portion of the film 13. Also, the position regulating portion 16*b*1 is formed from an upstream side toward a downstream side of the flange 16*b* with respect to the feeding direction C of the recording material S. The position regulating portion 16*b*1 is provided with first positioning portions 21*b*1, a second positioning portion 21*b*2 and a third positioning portion 22*b*. By these positioning portions, the flange 16*b* is positioned relative to the frame 19*b*.

With respect to the longitudinal direction (X-axis direction) of the pressing roller 17, the positioning portions 21*b*1 oppose an inside surface 19*b*1 of the frame 19*b*, and the positioning portion 21*b*2 opposes an outside surface 19*b*2 of the frame 19*b*. With respect to the feeding direction C (Y-axis direction) of the pressing roller 17, the positioning portion 22*b* opposes an edge portion 19*b*3 ((b) of FIG. 2 and FIG. 10) of the frame 19*b* forming the groove 31*b*.

Therefore, the flange 16*b* is positioned relative to the frame 19*b* by the positioning portions 21*b*1, 21*b*2 with respect to the X-axis direction and by the positioning portion 22*b* with respect to the Y-axis direction.

With respect to the X-axis direction, the position of the film 13 is regulated by surfaces 23*a*, 23*b*, on the film 13 side, of the position regulating portions 16*a*1, 16*a*2 of the flanges 16*a*, 16*b*. These surfaces 23*a*, 23*b* are positioned closer to the film 13 than surfaces 26*a*1, 26*b*1, on the film 13 side, of first and second end portion positioning portions 26*a*, 26*b*, described later, of the heater holder 15 are positioned. That is, the surfaces 26*a*1, 26*b*1 of the heater holder 15 are disposed outside the surfaces 23*a*, 23*b* of the flanges 16*a*, 16*b* with respect to the fixing device longitudinal direction (X-axis direction).

For this reason, the end portion positioning portions 26*a*, 26*b* of the heater holder 15 do not contact the end portions of the film 13.

Next, with reference to FIGS. 4, 7, 8 and 10, positioning of the heater holder 15 relative to the frames 19*a*, 19*b* will be described.

The heater holder 15 includes the end portion positioning portion 26*a* for positioning the heater holder 15 relative to the frame 19*a* with respect to the X-axis direction and the Y-axis direction. Here, the end portion positioning portion 26*a* is disposed at a left side end portion 15*a* of the heater holder 15 in the same side as a side where a first abutment portion 29, described later, for positioning the heater 14 relative to the heater holder 15 with respect to the X-axis direction. The end portion positioning portion 26*a* is provided with first positioning portions 24*a*1, a second positioning portion 24*a*2, and a third positioning portion 25*a*.

With respect to the X-axis direction, the positioning portions 24*a*1 oppose the inside frame surface 19*a*1, and the positioning portion 24*a*2 opposes the outside frame surface 19*a*2. With respect to the Y-axis direction, the positioning portion 25*a* opposes the edge portion 19*a*3 ((*a*) of FIG. 2 and FIG. 10) of the frame 19*a* forming the groove 31*a*.

Therefore, the heater holder 15 is positioned relative to the frame 19*a* by the positioning portions 24*a*1, 24*a*2 with respect to the X-axis direction and by the positioning portion 25*a* with respect to the Y-axis direction.

Between the positioning portions 24*a*1, 24*a*2, a gap determined in consideration of dimensional tolerances and thermal expansion of components (parts) is provided. The frame 19*a* is formed with a steel plate, and a plate thickness is from 0.6 mm to 1.2 mm. For that reason, the gap can be made relatively small.

Further, the heater holder 15 includes the end portion positioning portion 26*b* for positioning the heater holder 15 relative to the frame 19*b* with respect to the Y-axis direction. The end portion positioning portion 26*b* has no positioning function relative to the frame 19*b* with respect to the X-axis direction. The end portion positioning portion 26*b* is provided with a third positioning portion 25*b*.

With respect to the Y-axis direction, the positioning portion 25*b* opposes the edge portion 19*b*3 ((*b*) of FIG. 2 and FIG. 10) of the frame 19*b* forming the groove 31*b*.

Therefore, the heater holder 15 is positioned relative to the frame 19*b* with respect to the Y-axis direction by the positioning portion 25*b* for the frame 19*b*, but is not positioned relative to the frame 19*b* with respect to the X-axis direction.

Next, with reference to FIG. 4, positioning between the heater holder 15 and the stay 27 will be described. At the end portion of the stay 27, in the frame 16*a* side, disposed on the heater holder 15, a recessed-shaped groove 28 is formed. The groove 28 includes positioning portions 28*a*1, 28*a*2 for positioning the stay 27 relative to the heater holder 15 with respect to the X-axis direction. The heater holder 15 is provided with a projected-shaped portion 129 with which the groove 28 engages.

Therefore, the stay 27 is positioned relative to the heater holder 15 with respect to the X-axis direction by the positioning portions 28*a*1, 28*a*2, but is not positioned relative to the heater holder 15 with respect to the Y-axis direction.

Next, with reference to FIGS. 5, 8 and 10, positioning of the heater 14 relative to the heater holder 15 will be described. FIG. 5 is a bottom view of the heating unit 18, from which the film 13 is demounted, as seen from the heater 14 side.

With respect to the X-axis direction, on an inner surface of the heater holder 15 at the recessed portion 15*a* in the frame 19*a* side, a first abutment portion 29 is provided. Further, on the inner surface at the recessed portion 15*a* in a downstream side with respect to the feeding direction C (Y-axis direction) of the recording material S, a second abutment portion 33*a* and a third abutment portion 33*b* are provided. The second abutment portion 33*a* is in the same position as the end portion positioning portion 26*a* with respect to the X-axis direction but is positioned toward the outside relative to the end portion positioning portion 26*a* with respect to the X-axis direction.

In the recessed portion 15*a*, one longitudinal end 14*d* of the heater 14 is abutted against the first abutment portion 29, and a downstream side surface 14*e* of the heater 14 with respect to the Y-axis direction is abutted against the second abutment portion 33*a* and the third abutment portion 33*b*.

Therefore, in the recessed portion 15*a*, the heater 14 is positioned with respect to the X-axis direction by the abutment portion 29 and is positioned with respect to the Y-axis direction by the abutment portions 33*a*, 33*b*. The other end 14*f* of the heater 14 with respect to the X-axis direction is made free without being abutted against the heater holder 15 and thus can absorb the dimensional tolerance and the thermal expansion of the components.

As described above, the heater holder 15 includes the positioning portion 26*a*, contacting the frame 19*a*, for determining the position of the heater holder 15 with respect to the longitudinal direction (X-axis direction) of the fixing device. As a result, positional accuracy of the heater 14 with respect to the longitudinal direction of the fixing device is enhanced, so that heat of the heater 14 can be effectively used and electric power consumption can be suppressed.

Further, in this embodiment, the position of the stay 27 with respect to the X-axis direction is determined by the heater holder 15. By this constitution, for example, it is possible to decrease a difference in distribution, with respect to the X-axis direction, of a width of the fixing nip N (with respect to the feeding direction C (Y-axis direction) between a printer A and a printer B manufactured by the same manufacturing line. For this reason, heat of the heater 14 can be effectively used, so that electric power consumption can be suppressed.

Further, an urging direction by the helical gear 38 is set at +X direction. As a result, when the helical gear 38 rotates, the pressing roller 17 shifts toward the frame 19*a* side. As described above, with respect to the X-axis direction, the heater holder 15 is positioned relative to the frame 19*a*. Further, the position of the heater 14 is determined by the positioning portion 29 of the heater holder 15, but the positioning portion 29 is provided at a position closer to the frame 19*a* than to the frame 19*b*. Thus, with respect to the X-axis direction, the positions of the pressing roller 17, the heater holder 15 and the heater 14 are determined on the basis of the frame 19*a*. By this constitution, among printer individuals, a deviation between a heat generating region of the heater 14 with respect to the X-axis direction and the position of the nip N with respect to the X-axis direction becomes small. For this reason, the heat of the heater 14 can be effectively used and the electric power consumption can be suppressed.

Further, also the positioning portion 28, of the heater holder 15, for positioning the stay 27 is provided at a position closer to the frame 19*a* than to the frame 19*b*. By these constitutions, in the case where the respective members are expanded by heat, any of the members extends in a direction (−X direction) from the frame 19*a* toward the frame 19*b*, and therefore a positioned deviation between the respective members can be suppressed to a low level.

As described above, in the fixing device 10 in this embodiment, the left side end portion 15*a* of the heater holder 15 is positioned in the groove 31*a* of the frame 19*a* via the end portion positioning portion 26*a*, and therefore positional accuracy of the heater 14 relative to the frame 19*a* is improved.

Embodiment 2

Figure 11:
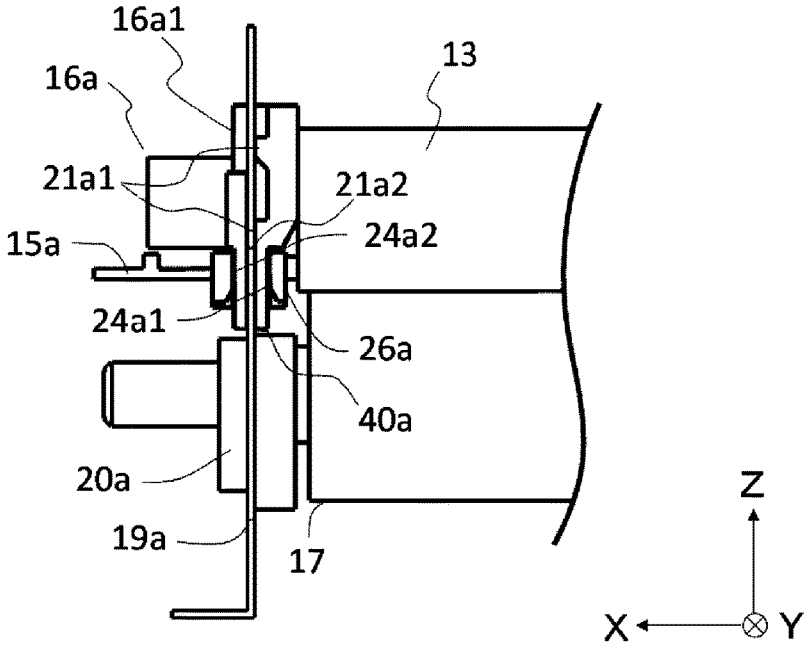
FIG. 11 is a front view showing a left side end portion of a fixing device in Embodiment 2.

With reference to FIG. 11, a fixing device 10 in this embodiment will be described. FIG. 11 is a front view of a left side end portion of the fixing device 10 in this embodiment as seen from a downstream side with respect to the feeding direction C of the recording material S.

In this embodiment, only the fixing device 10 is different from the fixing device 10 in Embodiment 1 described above, and therefore the different portion will be principally described, and portions having the same constitutions as those in Embodiment 1 are represented by the same reference numerals or symbols and will be omitted from description. This is true for also Embodiments 3 to 6.

With respect to the longitudinal direction of the pressing roller 17, the flange 16*a* is positioned relative to the frame 19*a* by the positioning portions 21*a*1, 21*a*2 of the position regulating portion 16*a*1. Further, a projected positioning portion 40*a* provided at a portion where the position regulating portion 16*a*1 is positioned relative to the frame 19*a* is sandwiched between the positioning portions 24*a*1, 24*a*2 of the end portion positioning portion 26*a* of the heater holder 15, so that positioning of the heater holder 15 is made.

Between the positioning portions 24*a*1, 24*a*2 of the heater holder 15, a gap determined in consideration of dimensional tolerances and thermal expansion of components is provided. A dimension, with respect to the roller longitudinal direction Y, of the projected positioning portion 40*a* of the flange 16*a* by which the heater holder 15 is positioned is from 4 mm to 6 mm. For that reason, the above-described gap can be made relatively small.

As described above, in the fixing device 10 in this embodiment, the left side end portion 15*a* of the heater holder 15 is positioned in the groove 31*a* of the frame 19*a* via the flange 16*a*, and therefore positional accuracy of the heater 14 relative to the frame 19*a* is improved.

Embodiment 3

Figure 12:
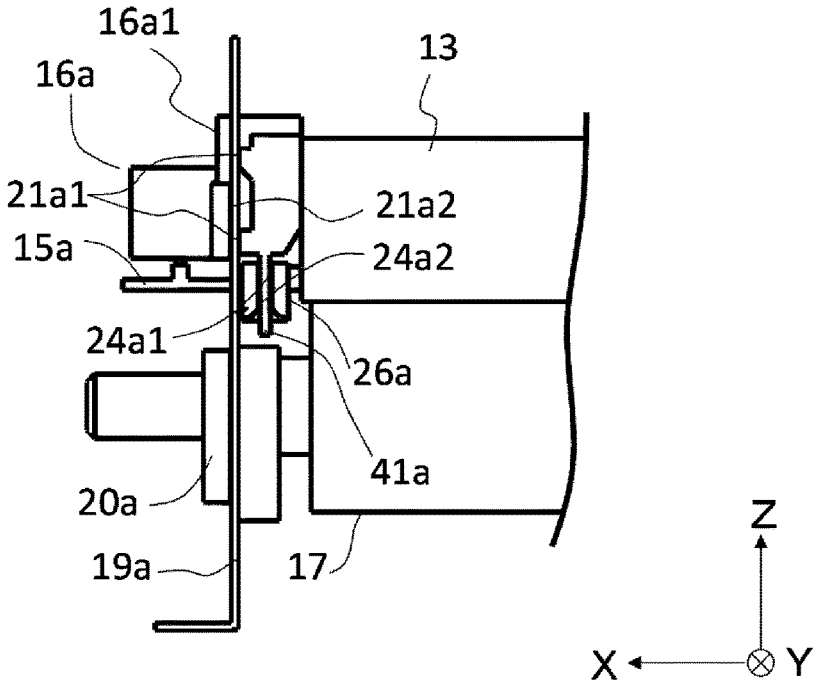
FIG. 12 is a front view showing a left side end portion of a fixing device in Embodiment 3.

With reference to FIG. 12, a fixing device 10 in this embodiment will be described. FIG. 12 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1, 21*a*2 of the position regulating portion 16*a*1. Further, a rib 41*a* provided at a portion other than a portion where the position regulating portion 16*a*1 is positioned relative to the frame 19*a* is sandwiched between the positioning portions 24*a*1, 24*a*2 of the end portion positioning portion 26*a* of the heater holder 15, so that positioning of the heater holder 15 is made.

Between the positioning portions 24*a*1, 24*a*2 of the heater holder 15, a gap determined in consideration of dimensional tolerances and thermal expansion of components is provided. A dimension, with respect to the roller longitudinal direction Y, of the rib 41*a* of the flange 16*a* by which the heater holder 15 is positioned is from 1 mm to 3 mm. For that reason, the above-described gap can be made relatively small.

As described above, in the fixing device 10 in this embodiment, the left side end portion 15*a* of the heater holder 15 is positioned in the groove 31*a* of the frame 19*a* via the flange 16*a*, and therefore positional accuracy of the heater 14 relative to the frame 19*a* is improved.

Embodiment 4

Figure 13:
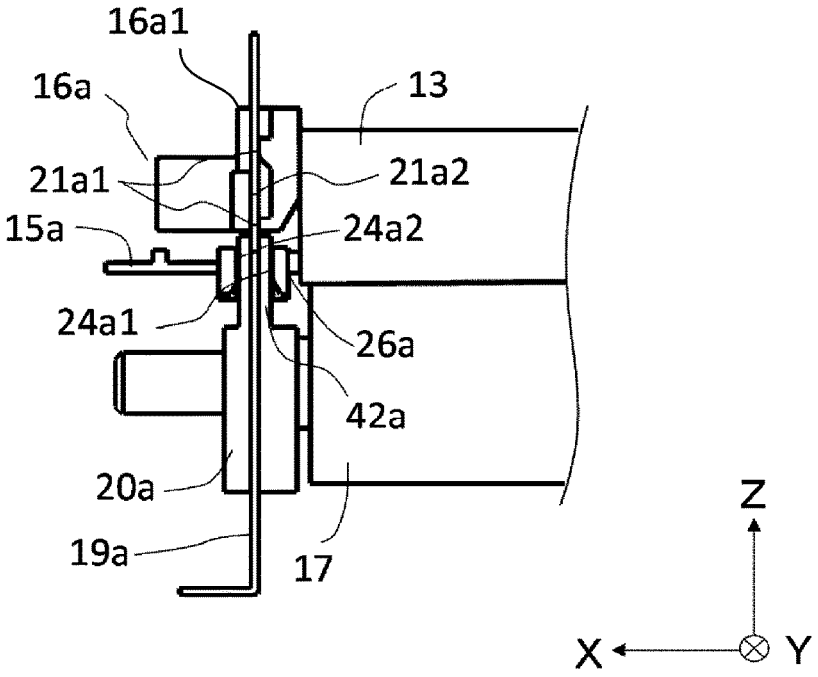
FIG. 13 is a front view showing a left side end portion of a fixing device in Embodiment 4.

With reference to FIG. 13, a fixing device 10 in this embodiment will be described. FIG. 13 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1, 21*a*2 of the position regulating portion 16*a*1. Further, a projected positioning portion 42*a* provided at a portion where the bearing 20*a* as a separate member is positioned relative to the frame 19*a* is sandwiched between the positioning portions 24*a*1, 24*a*2 of the end portion positioning portion 26*a* of the heater holder 15, so that positioning of the heater holder 15 is made.

Between the positioning portions 24*a*1, 24*a*2 of the heater holder 15, a gap determined in consideration of dimensional tolerances and thermal expansion of components is provided. A dimension, with respect to the longitudinal direction of the pressing roller 17, of the projected positioning portion 40*a* of the bearing 20*a* by which the heater holder 15 is positioned is from 4 mm to 6 mm. For that reason, the above-described gap can be made relatively small.

As described above, in the fixing device 10 in this embodiment, the left side end portion 15*a* of the heater holder 15 is positioned in the groove 31*a* of the frame 19*a* via the bearing 20*a*, and therefore positional accuracy of the heater 14 relative to the frame 19*a* is improved.

Embodiment 5

Figure 14:
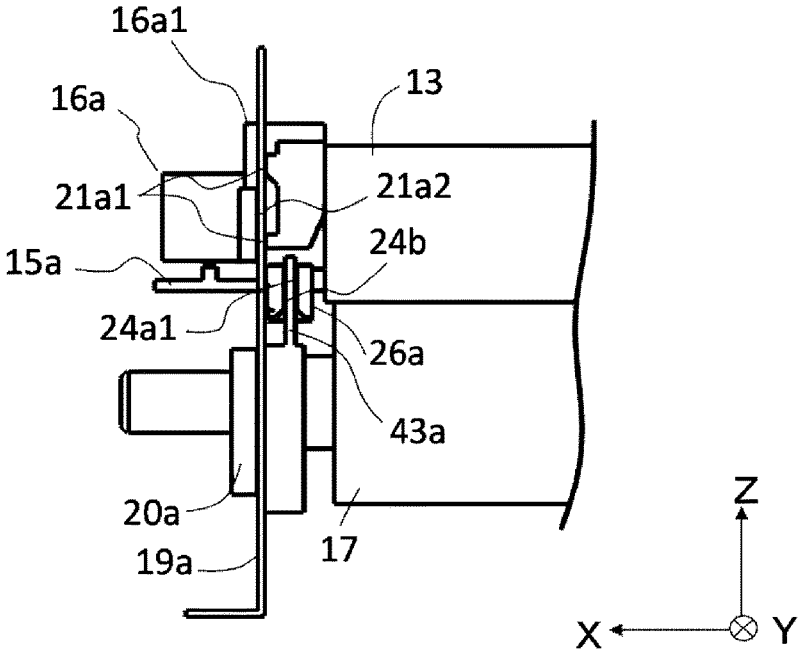
FIG. 14 is a front view showing a left side end portion of a fixing device in Embodiment 5.

With reference to FIG. 14, a fixing device 10 in this embodiment will be described. FIG. 14 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1, 21*a*2 of the position regulating portion 16*a*1. Further, a rib 43*a* provided at a portion other than a portion where the bearing 20*a* as a separate member is positioned relative to the frame 19*a* is sandwiched between the positioning portions 24*a*1, 24*a*2 of the end portion positioning portion 26*a* of the heater holder 15, so that positioning of the heater holder 15 is made.

Between the positioning portions 24*a*1, 24*a*2 of the heater holder 15, a gap determined in consideration of dimensional tolerances and thermal expansion of components is provided. A dimension, with respect to the longitudinal direction of the pressing roller 17, of the rib 43*a* of the bearing 20*a* by which the heater holder 15 is positioned is from 1 mm to 3 mm. For that reason, the above-described gap can be made relatively small.

As described above, in the fixing device 10 in this embodiment, the left side end portion 15*a* of the heater holder 15 is positioned in the groove 31*a* of the frame 19*a* via the bearing 20*a*, and therefore positional accuracy of the heater 14 relative to the frame 19*a* is improved.

Embodiment 6

In the fixing devices 10 in the above-described embodiments, with respect to the feeding direction C of the recording material S, the width of each of the grooves 31*a*, 31*b* is made larger than the width between the positioning portions 22*a* of the flange 19*a* and the width between the positioning portions 22*b* of the flange 19*b* in some cases in view of the dimensional tolerances and the thermal expansion of the components. Similarly, in some cases, the width of each of the grooves 31*a*, 31*b* is made larger than the width between the positioning portions 25*a* of the heater holder 15 and the width between the positioning portions 25*b* of the heater holder 15. In this case, with respect to the feeding direction C of the recording material S, a gap generates between the heating unit 18 and the frames 19*a*, 19*b*.

Accordingly, between the flanges 16*a*, 16*b* and the grooves 31*a*, 31*b*, and between the heater holder 15 and the grooves 31*a*, 31*b*, there are gaps with respect to the feeding direction C of the recording material S, so that an attitude of the heating unit 18 is not fixed only when the heating unit 18 is engaged with the grooves 30*a*, 30*b*.

Therefore, in the fixing device 10 in this embodiment, a constitution in which the attitude of the heating unit 18 is held by causing the heating unit 18 to contact only the downstream side groove 31*a* with respect to the feeding direction C of the recording material S was employed.

Figure 15:
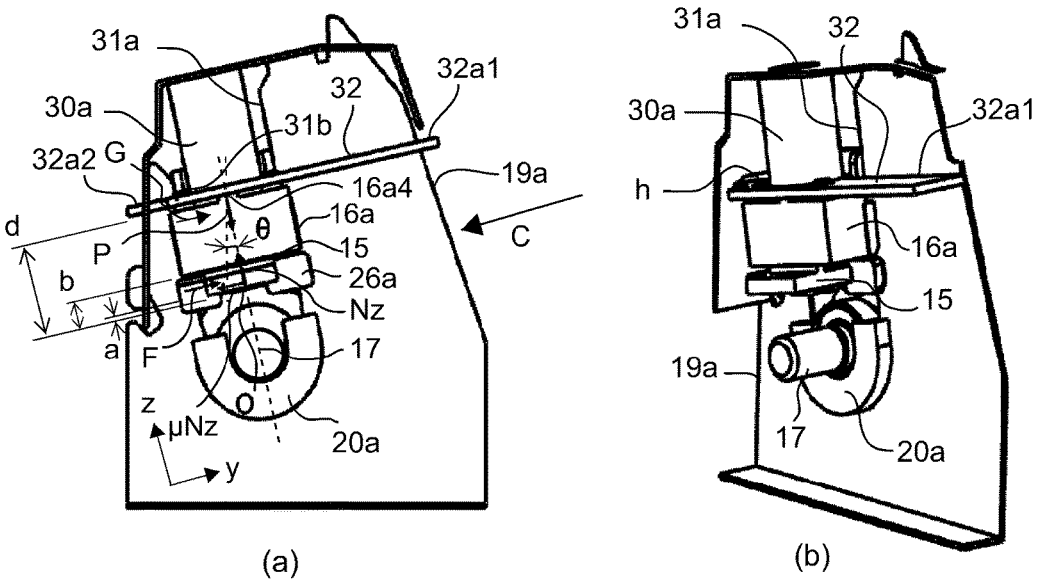
In FIG. 15, (*a*) and (*b*) are a left side view and a perspective view, respectively, of a fixing device in Embodiment 6.

With reference to FIG. 15, the fixing device 10 in this embodiment will be described. In FIG. 15, (*a*) is a left side view of the fixing device 10 in this embodiment, and (*b*) is a perspective view of the left side end portion of the fixing device 10 in this embodiment as seen from an upstream side with respect to the feeding direction C of the recording material S.

The pressing plate 32*a* functions as a lever and presses (urges) the heating unit 18 toward the pressing roller 17 along the groove 31*a* of the frame 19*a*. One end 32*a*1 of the pressing plate 32*a* is passed through a hole h provided in the frame 19*a* and constitutes a fulcrum, and a pressing spring 30*a* is disposed and compressed between the pressing plate 32*a* and a bent portion 35*a* of the frame 19*a*, and the other end 32*a*2 constitutes a force application point. Further, an intermediary portion of the pressing plate 32*a* constitutes a point of action where a pressing portion 16*a*4 provided on the flange 16*a* is pressed.

As pressing springs 30*a*, 30*b*, it is also possible to apply a tension spring in place of the compression spring used in this embodiment.

By the above pressing constitution, the nip N is formed by the pressing roller 17 in cooperation with the heater 14 via the film 13. The pressing portion 16*a*4 of the flange 16*a* is an arcuately projected portion and is on a common normal (including a center of the pressing roller 17 in this embodiment) to a nip surface (plane) passing through a center of the nip N. A normal (line) is formed by shifting by a predetermined angle θ with respect to the common normal direction at the nip N which is a press-contact portion between the heating unit 18 and the pressing roller 17.

Next, what becomes of the attitude of the heating unit 18 in the groove 31*a* provided with the gap, i.e., behavior of the heating unit 18 will be described. Basically, a constitution in which in a state in which the heating unit 18 and the pressing roller 17 are driven, depending on a force relationship between external forces acting on the heating unit 18, the heating unit 18 is locked only at a groove side edge portion 19*a*3 of the frame 19*a* in the downstream side with respect to the recording material feeding direction and thus the attitude of the heating unit 18 is held. These external forces will be described below specifically.

In (*a*) of FIG. 15, the external forces acting on the heating unit 18 are shown. In the figure, respective symbols are as follows.

P: Pressing force of the pressing plate 32*a* against the pressing portion 16*a*4 of the flange 16*a* (pressing point normal direction)

Nz: Reaction from the pressing roller 17

F: Reaction received from the groove side edge portion 19*a*3 of the frame 19*a* in the downstream side with respect to the feeding direction C of the recording material S by the positioning portion 25*a* of the heater holder 15 (in the case of F<0, reaction received from the groove side edge portion 19*a*3 of the frame 19*a* in the upstream side with respect to the feeding direction C of the recording material S by the positioning portion 25*a*)

G: Reaction received from the groove side edge portion 19*a*3 of the frame 19*a* in the downstream side with respect to the feeding direction C of the recording material S by the positioning portion 22*a* of the flange 16*a* (in the case of F<0, reaction received from the groove side edge portion 19*a*3 of the frame 19 in the upstream side with respect to the feeding direction C of the recording material S by the positioning portion 22*a*)

μm: Friction coefficient between the film 13 and the heater 14 a: Distance from the nip N to the positioning portion 25*a* b: Distance from the nip N to the positioning portion 22*a* d: Distance from the nip N to the pressing portion 16*a*4

θ: Angle formed between the common normal and the groove 31*a* at the point of contact between the pressing plate 32*a* and the pressing portion 16*a*4

The force with respect to the z direction (direction parallel to the groove), the force with respect to the y direction (direction perpendicular to the groove) and a balance expression of rotation moment around a point O (center of the nip N) are as follows:

Force (z direction): $P \cos \theta = Nz$

Force (y direction): $F+G=\mu Nz+P \sin \theta$

Rotation moment around O: $aF+bG=dP \sin \theta$

From the above three formulas, the following two formulas are satisfied.

$$F=P\{b(\sin \theta+\mu \cos \theta)-d \sin \theta\}/(b-a)$$

$$G=P\{d \sin \theta-a(\sin \theta+\mu \cos \theta)\}/(b-a)$$

Here, in this embodiment, μ is obtained by actual measurement, a, b, d, θ are set to satisfy the relationship of: $b(\sin \theta+\mu \cos \theta)>d \sin \theta>a(\sin \theta+\mu \cos \theta)$, and F>O and G>O. That is, both of the positioning portion 25*a* of the heater holder 15 and the positioning portion 22*a* of the flange 16*a* in the heating unit 18 abut against the groove side edge portion 19*a*3 of the frame 19*a* in the downstream side with respect to the feeding direction C of the recording material S.

Accordingly, the attitude of the heating unit 18 is influenced only by the dimensions of the positioning portion 25*a* of the heater holder 15, the positioning portion 22*a* of the flange 16*a* and the groove side edge portion 19*a*3 of the frame 19, and therefore positional accuracy of the heater 14 is improved.

As described above, in the fixing device 10 in this embodiment, the rotation moment in a direction in which the attitude of the heater 14 is inclined acts on the heater 14 by rotation of the pressing roller 17 in the feeding direction C of the recording material S. A constitution in which even when such rotation moment acts on the heater 14, the pressing spring 30*a* urges the flange 16*a* so as to maintain a state in which the heater holder 15 and the flange 16*a* contact the groove side edge portion 19*a*3 in the downstream side with respect to the feeding direction C of the recording material S is employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-094742 filed on May 7, 2015, and 2016-050770 filed on Mar. 15, 2016, which are hereby incorporated by reference herein in their entirety.

What is claimed is:

1. An image heating apparatus comprising:

a frame including a first side plate provided at one end portion and a second side plate provided at another end portion with respect to a longitudinal direction of said image heating apparatus;

a cylindrical rotatable member provided between said first and second side plates;

a heater contacting an inner surface of said rotatable member;

a holder for holding said heater, said holder having a positioning portion, said positioning portion (i) contacting said first side plate, and (ii) positioning said holder relative to said first side plate in the longitudinal direction, wherein said holder is provided in an inside space of said rotatable member, and with respect to the longitudinal direction, a length of said holder is greater than a distance between said first side plate and said second side plate;

a first preventing member, contactable to one end surface of said rotatable member when said rotatable member moves toward said first side plate, for preventing movement of said rotatable member in the longitudinal direction; and a second preventing member, contactable to another end surface of said rotatable member when said rotatable member moves toward said second side plate, for preventing the movement of said rotatable member in the longitudinal direction, wherein an image formed on a recording material is heated by heat of said heater while moving in a state in which the recording material contacts said rotatable member, and wherein said holder is not integral with said first and second preventing members.

2. An image heating apparatus according to claim 1, wherein said first preventing member engages with said first side plate and said second preventing member engages with said second side plate.

3. An image heating apparatus according to claim 1, further comprising a stay that is formed of metal in the inside space of said rotatable member and that has a length greater than the distance between said first and second side plates, wherein a position of said stay with respect to the longitudinal direction is determined by said holder.

4. An image heating apparatus according to claim 3, wherein a portion of said holder, where the position of said stay is determined by said holder, is provided at a position closer to said first side plate than to said second side plate.

5. An image heating apparatus according to claim 1, further comprising (i) a roller for nipping and feeding the recording material via said rotatable member in cooperation with said heater, and (ii) a helical gear mounted to said roller and that rotates to generate a force in a direction from said second side plate toward said first side plate.

6. An image heating apparatus according to claim 1, wherein said rotatable member is a film.

7. An image heating apparatus according to claim 1, wherein said holder includes a second positioning portion, contacting said second side plate, for positioning said holder relative to said second side plate with respect to a recording material conveying direction.

8. An image heating apparatus according to claim 7, wherein said second positioning portion opposes an edge portion of said second side plate forming a groove with respect to the recording material conveying direction.

9. An image heating apparatus according to claim 1, wherein said positioning portion is integral to said holder.

10. An image heating apparatus according to claim 5, wherein said positioning portion is integral to said holder.

11. An image heating apparatus according to claim 7, wherein said positioning portion is integral to said holder.

12. An image heating apparatus comprising:

a frame including a first side plate provided at one end portion and a second side plate provided at another end portion with respect to a longitudinal direction of said image heating apparatus;

a cylindrical rotatable member provided between said first and second side plates;

a heater contacting an inner surface of said rotatable member;

a holder for holding said heater, said holder having a positioning portion, said positioning portion (i) contacting said first side plate, and (ii) positioning said holder relative to said first side plate in the longitudinal direction, wherein said holder is provided in an inside space of said rotatable member, and with respect to the longitudinal direction, a length of said holder is greater than a distance between said first side plate and said second side plate; and a preventing member, contactable to one end surface of said rotatable member when said rotatable member moves toward said first side plate, for preventing movement of said rotatable member in the longitudinal direction, wherein an image formed on a recording material is heated by heat of said heater while moving in a state in which the recording material contacts said rotatable member, and wherein said holder and said preventing member are parts that are independent of each other.

13. An image heating apparatus according to claim 12, wherein said preventing member engages with said first side plate.

14. An image heating apparatus according to claim 12, further comprising a stay that is formed of metal in the inside space of said rotatable member and that has a length greater than the distance between said first and second side plates, wherein a position of said stay with respect to the longitudinal direction is determined by said holder.

15. An image heating apparatus according to claim 14, wherein a portion of said holder, where the position of said stay is determined by said holder, is provided at a position closer to said first side plate than to said second side plate.

16. An image heating apparatus according to claim 12, further comprising (i) a roller for nipping and feeding the recording material via said rotatable member in cooperation with said heater, and (ii) a helical gear mounted to said roller and that rotates to generate a force in a direction from said second side plate toward said first side plate.

17. An image heating apparatus according to claim 12, wherein said rotatable member is a film.

18. An image heating apparatus according to claim 12, wherein said holder includes a second positioning portion, contacting said second side plate, for positioning said holder relative to said second side plate with respect to a recording material conveying direction.

19. An image heating apparatus according to claim 18, wherein said second positioning portion opposes an edge portion of said second side plate forming a groove with respect to the recording material conveying direction.

* * * * *